US008096005B2

(12) United States Patent
Carletti et al.

(10) Patent No.: US 8,096,005 B2
(45) Date of Patent: Jan. 17, 2012

(54) DEVICE FOR THE ASSISTED LOADING OF STRETCHER

(75) Inventors: Enrico Carletti, Pieve di cento (IT); Alessandro Lapini, San Casciano (IT)

(73) Assignee: Ferno-Washington, Inc., Wilmington, OH (US)

( * ) Notice: Subject to any disclaimer, the term of this patent is extended or adjusted under 35 U.S.C. 154(b) by 522 days.

(21) Appl. No.: 12/096,657

(22) PCT Filed: Dec. 15, 2006

(86) PCT No.: PCT/IB2006/003633

§ 371 (c)(1),
(2), (4) Date: Jun. 9, 2008

(87) PCT Pub. No.: WO2007/069066

PCT Pub. Date: Jun. 21, 2007

(65) Prior Publication Data

US 2009/0000834 A1 Jan. 1, 2009

(30) Foreign Application Priority Data

Dec. 16, 2005 (IT) ..... BO2005A0770

(51) Int. Cl.
*A61G 7/10* (2006.01)

(52) U.S. Cl. ..... 5/86.1; 5/611; 180/65.1

(58) Field of Classification Search ..... 180/65.5, 180/65.1, 6.5, 11, 19.1, 19.3; 280/638, 640; 296/20; 5/86.1, 600, 611
See application file for complete search history.

(56) References Cited

U.S. PATENT DOCUMENTS

| | | | | | |
|---|---|---|---|---|---|
| 3,380,546 | A | * | 4/1968 | Rabjohn | 180/15 |
| 3,493,262 | A | * | 2/1970 | Ferneau | 296/20 |
| 3,498,628 | A | * | 3/1970 | Ferneau et al. | 280/641 |
| 3,637,232 | A | * | 1/1972 | Bourgraf et al. | 280/641 |
| 3,808,899 | A | * | 5/1974 | Cooper | 476/16 |
| 3,826,528 | A | * | 7/1974 | East | 296/20 |
| 4,097,941 | A | * | 7/1978 | Merkel | 5/86.1 |
| 4,921,295 | A | * | 5/1990 | Stollenwerk | 296/20 |
| 5,015,024 | A | * | 5/1991 | Bloemer | 296/20 |
| 5,064,012 | A | * | 11/1991 | Losego | 180/19.1 |
| 5,137,102 | A | * | 8/1992 | Houston et al. | 180/65.51 |
| 5,163,189 | A | * | 11/1992 | DeGray | 5/86.1 |
| 5,224,562 | A | * | 7/1993 | Reed | 180/6.5 |
| 5,445,233 | A | * | 8/1995 | Fernie et al. | 180/6.5 |
| 5,465,801 | A | * | 11/1995 | Hoover | 180/19.1 |

(Continued)

FOREIGN PATENT DOCUMENTS

DE 19958893 A1 6/2001

(Continued)

OTHER PUBLICATIONS

Chinese Office Action dated Jan. 8, 2010 pertaining to Chinese Application for Invention No. 200680047179.X.

*Primary Examiner* — J. Allen Shriver, II
*Assistant Examiner* — Brodie Follman
(74) *Attorney, Agent, or Firm* — Dinsmore & Shohl LLP

(57) ABSTRACT

A device for the assisted loading of a stretcher (2) provided with a chassis (3), comprises at least one driving wheel (4) cinematically connected to a driving member (5) fed by feeding means (6) and controlled by control means (7) to activate the at least one driving wheel (4) at least during the loading of the stretcher into the ambulance.

14 Claims, 4 Drawing Sheets

U.S. PATENT DOCUMENTS 5,596,775 A * 1/1997 DiMatteo et al. ..... 5/81.1 C
5,718,105 A * 2/1998 Irikura et al. ..... 56/11.4
5,927,414 A * 7/1999 Kan et al. ..... 180/19.3
5,933,888 A * 8/1999 Foster et al. ..... 5/604
5,937,456 A * 8/1999 Norris ..... 5/88.1
5,983,425 A * 11/1999 DiMucci et al. ..... 5/611
5,987,671 A * 11/1999 Heimbrock et al. ..... 5/600
6,019,682 A * 2/2000 Arabo ..... 463/52
6,062,328 A * 5/2000 Campbell et al. ..... 180/65.6
6,065,557 A * 5/2000 von Keyserling ..... 180/221
6,070,899 A * 6/2000 Gines ..... 280/651
6,178,575 B1 * 1/2001 Harada ..... 5/600
6,203,085 B1 * 3/2001 Ferris ..... 296/20
6,286,165 B1 * 9/2001 Heimbrock et al. ..... 5/600
6,295,487 B1 * 9/2001 Ono et al. ..... 701/22
6,321,878 B1 * 11/2001 Mobley et al. ..... 188/1.12
6,363,555 B1 * 4/2002 LaRose ..... 5/600
6,481,413 B2 * 11/2002 Chang ..... 123/399
6,505,359 B2 * 1/2003 Heimbrock et al. ..... 5/86.1
6,575,491 B2 * 6/2003 Miller ..... 280/638
6,588,523 B2 * 7/2003 Heimbrock et al. ..... 180/65.51
6,598,247 B1 * 7/2003 Heimbrock et al. ..... 5/86.1
6,701,554 B2 * 3/2004 Heimbrock ..... 5/623
6,729,421 B1 * 5/2004 Gluck et al. ..... 180/11
6,735,794 B1 * 5/2004 Way et al. ..... 5/86.1
6,749,034 B2 * 6/2004 Vogel et al. ..... 180/19.1
6,772,850 B1 * 8/2004 Waters et al. ..... 180/65.51
6,902,019 B2 * 6/2005 Heimbrock et al. ..... 180/65.51
6,976,696 B2 * 12/2005 O'Krangley et al. ..... 280/640
6,978,499 B2 * 12/2005 Gallant et al. ..... 5/600
7,011,172 B2 * 3/2006 Heimbrock et al. ..... 180/65.51
7,013,510 B1 * 3/2006 Johnson ..... 5/611
7,021,407 B2 * 4/2006 Ruschke et al. ..... 180/11
7,090,041 B2 * 8/2006 Vogel et al. ..... 180/19.3
7,191,854 B2 * 3/2007 Lenkman ..... 180/65.1
7,195,253 B2 * 3/2007 Vogel et al. ..... 280/19.1
7,271,555 B1 * 9/2007 Ciccone ..... 318/139
7,284,626 B2 * 10/2007 Heimbrock et al. ..... 180/65.1
7,334,277 B2 * 2/2008 Johnson ..... 5/611
7,407,024 B2 * 8/2008 Vogel et al. ..... 180/19.3
7,419,019 B1 * 9/2008 White et al. ..... 180/19.3
7,530,412 B2 * 5/2009 Heimbrock et al. ..... 180/65.1
7,621,003 B2 * 11/2009 Myers et al. ..... 5/86.1
7,636,961 B1 * 12/2009 Starkey ..... 5/11
7,725,968 B2 * 6/2010 Lambarth ..... 5/611
7,770,674 B2 * 8/2010 Miles et al. ..... 180/65.1
7,828,092 B2 * 11/2010 Vogel et al. ..... 180/19.3
7,856,685 B2 * 12/2010 Matunaga et al. ..... 5/611
7,886,377 B2 * 2/2011 Hamberg et al. ..... 5/86.1
7,887,113 B2 * 2/2011 Lambarth et al. ..... 296/20
7,922,183 B2 * 4/2011 Figel et al. ..... 280/47.38
2002/0043411 A1 * 4/2002 Heimbrock et al. ..... 180/65.5
2002/0079146 A1 * 6/2002 Chen ..... 180/65.1
2003/0192725 A1 10/2003 Heimbrock et al.
2004/0088792 A1 * 5/2004 O'Krangley et al. ..... 5/611
2005/0072610 A1 * 4/2005 Heimbrock et al. ..... 180/65.5
2005/0126835 A1 * 6/2005 Lenkman ..... 180/65.1
2006/0075558 A1 * 4/2006 Lambarth et al. ..... 5/611
2006/0082176 A1 * 4/2006 Broadley et al. ..... 296/20
2006/0123545 A1 * 6/2006 Johnson ..... 5/611
2006/0195987 A1 * 9/2006 Walkingshaw ..... 5/627
2006/0207027 A1 * 9/2006 Matunaga et al. ..... 5/611
2006/0225203 A1 * 10/2006 Hosoya et al. ..... 5/86.1
2007/0034424 A1 * 2/2007 Snowden et al. ..... 180/65.1
2007/0079998 A1 * 4/2007 Walter ..... 180/19.1
2007/0095582 A1 * 5/2007 Stuijt et al. ..... 180/65.1
2007/0199743 A1 * 8/2007 Hsiao ..... 180/65.1
2008/0303248 A1 * 12/2008 Chaparro ..... 280/651
2009/0001740 A1 * 1/2009 Kofoed et al. ..... 296/20
2009/0015027 A1 * 1/2009 Lambarth et al. ..... 296/20
2009/0051184 A1 * 2/2009 Saleem ..... 296/20
2009/0078479 A1 * 3/2009 Williamson et al. ..... 180/19.1
2009/0165207 A1 * 7/2009 Reed et al. ..... 5/611
2009/0165208 A1 * 7/2009 Reed et al. ..... 5/611
2009/0276959 A1 * 11/2009 Menna ..... 5/611
2010/0175933 A1 * 7/2010 Yoshida ..... 180/65.1
2010/0293712 A1 * 11/2010 Pizzi Spadoni ..... 5/86.1
2011/0018296 A1 * 1/2011 Broadley et al. ..... 296/20
2011/0030141 A1 * 2/2011 Soderberg et al. ..... 5/600
2011/0080016 A1 * 4/2011 Lambarth et al. ..... 296/20
2011/0101718 A1 * 5/2011 West, III ..... 296/20

FOREIGN PATENT DOCUMENTS

EP 0948953 A 10/1999
EP 0972505 A 1/2000
GB 2156291 A * 10/1985
GB 2400805 A * 10/2004

* cited by examiner

DEVICE FOR THE ASSISTED LOADING OF STRETCHER

TECHNICAL FIELD

The present invention relates to the technical field of the medical devices used for transporting patients and it refers to a device for the assisted loading of a stretcher particularly suitable to facilitate the insertion and the loading of the stretcher in an ambulance or the like.

BACKGROUND ART

There are known ambulance stretchers equipped with pivoting legs folded in a direction parallel to the stretcher positioned inside of the ambulance and that, when coming out from this ambulance, they rotate about 90° disposing themselves vertically in order to support the plane of the stretcher.

An end of each leg has a wheel for the movement of the stretcher out of the ambulance.

When the stretcher is loaded with the patient in the space of the ambulance, the legs contact a counterpart of the ambulance and they are refolded.

A drawback of said known stretchers consists in that when loading in the ambulance, the operators need to use a considerable effort to provide the necessary energy for loading the heavy stretcher with the patient and to refold the legs.

Other drawback consists in that the impact between the legs and the counterpart of the ambulance, due to the eventual small run-up made by the operator, can be violent and thus irritating, painful and harmful for the patient particularly for the traumatized patient.

DISCLOSURE OF THE INVENTION

An object of the present invention is to propose a device for the assisted loading of a stretcher, being able to reduce or avoid the effort of the operator when loading and/or unloading the stretcher with the patient.

Other object is to propose a device that allows to reduce the impact between the legs of the stretcher and the ambulance in order to increase the comfort and the safety for the patient.

The above mentioned objects can be obtained in accordance with the content of the claims.

BRIEF DESCRIPTION OF THE DRAWINGS

The characteristics of the invention are evidenced in the following with particular reference to the attached drawings, in which.

BEST MODE OF CARRYING OUT THE INVENTION

Figure 1:
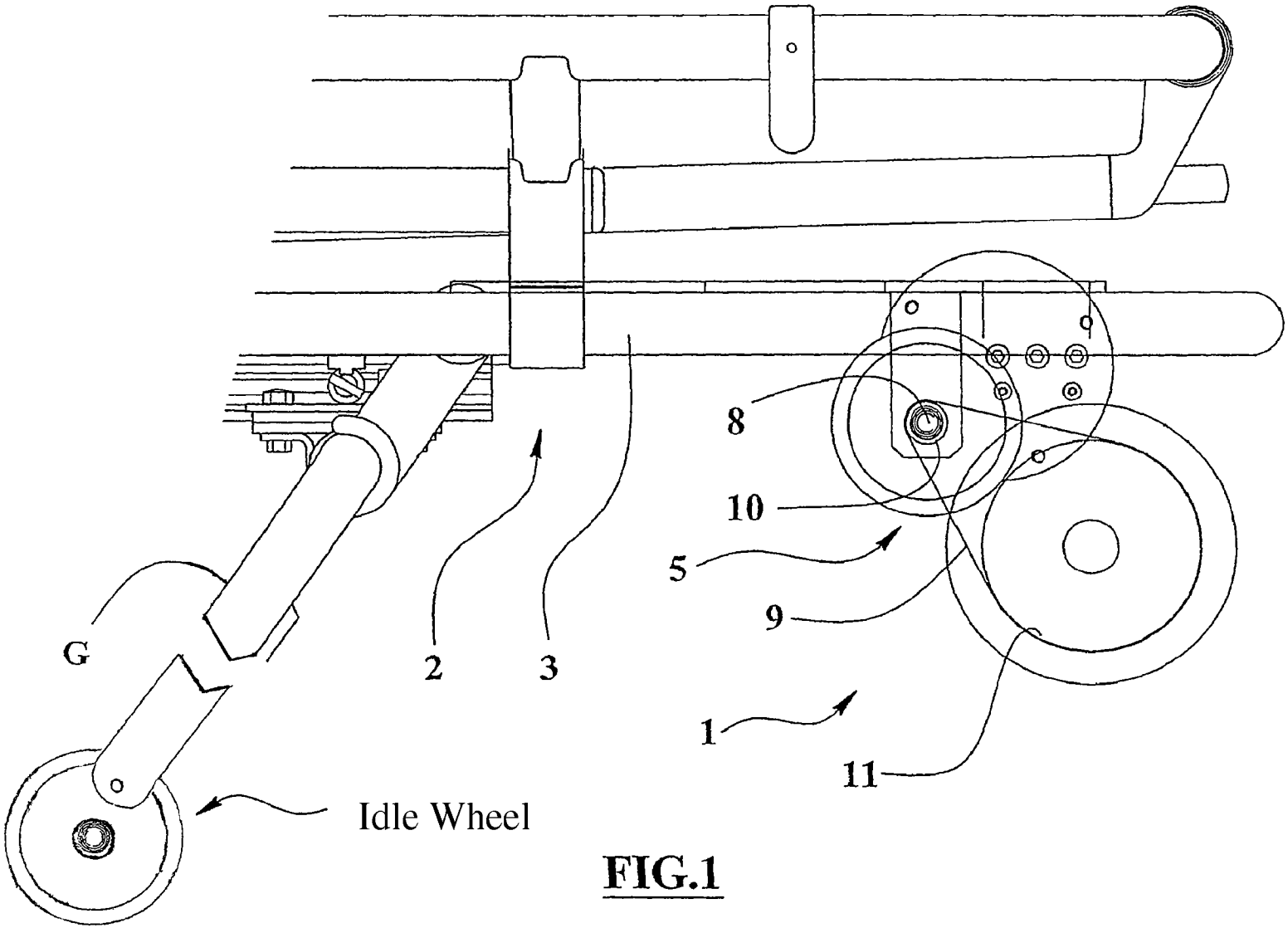
FIG. 1 shows a schematic partial side view of the device for the assisted loading, associated to a stretcher only partially visible.
Figure 3:
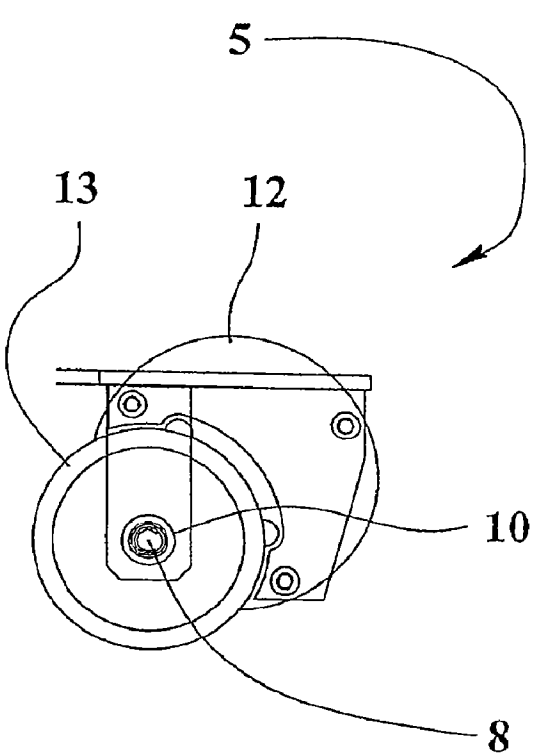
FIGS. 2 and 3 show respectively front view and side view of a driving member of FIG. 1.
Figure 2:
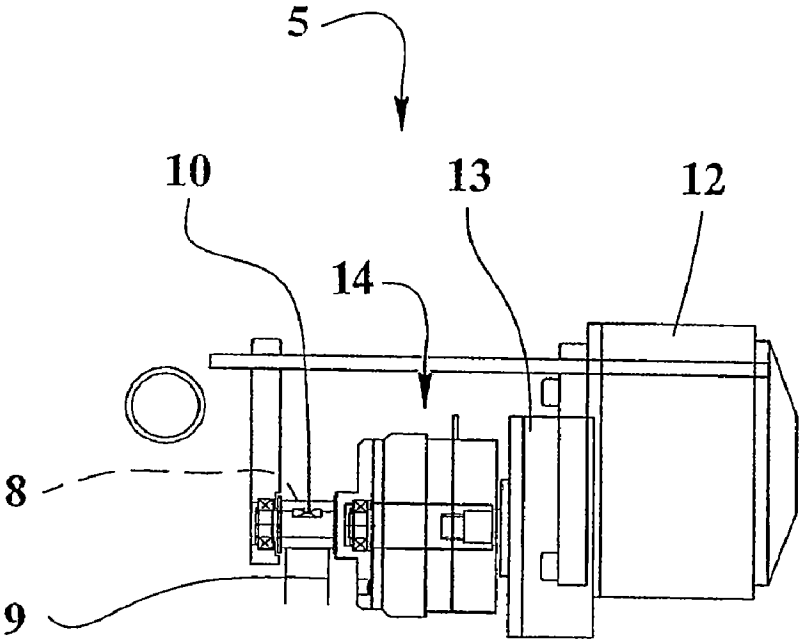
Figure 4:
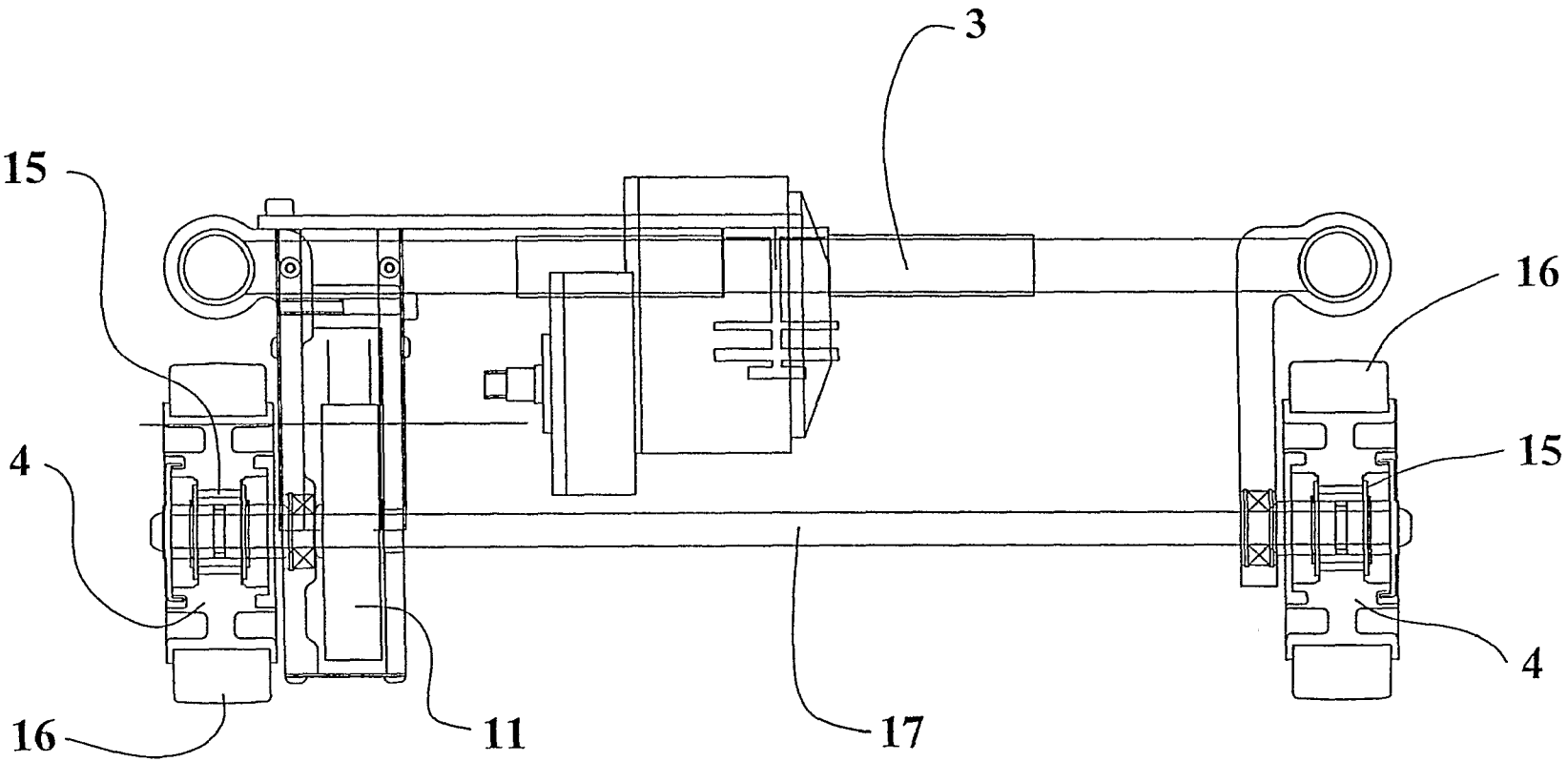
FIGS. 4 and 5 show respectively front view and top view of the device and of the stretcher of FIG. 1 in which some parts are removed to better evidence others parts.
Figure 5:
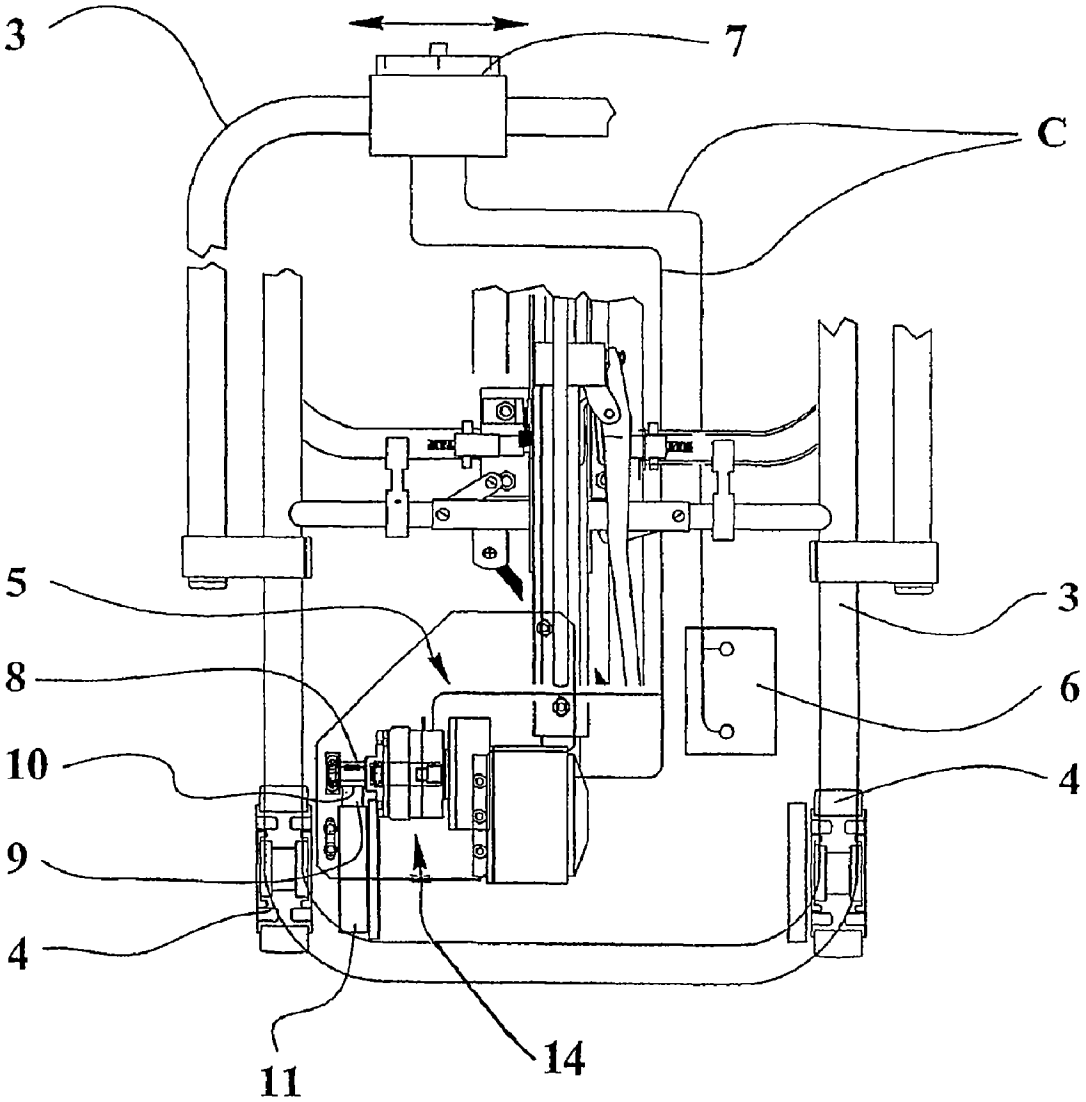

With reference to the FIGS. 1-5, numeral 1 indicates the device for the assisted loading of a stretcher 2, for example of the type for ambulances, provided with a chassis 3 and pivoting legs G for the idle wheels fit for moving the stretcher.

The device 1 comprises a pair of lateral driving wheels 4 disposed in the front lower portion of the chassis 3, in front of the front pivoting legs G, in order to engage the loading ramp of the ambulance during the loading and unloading phases of the stretcher.

Said driving wheels 4 are connected to a transmission axis 17 to which is fixed a pulley 11 of the driving wheels cinematically connected, by means of a timing belt 9, to a pulley 10 of an outlet shaft 8 of a driving member 5.

Said driving member 5 is fed by feeding mean 6 by means of control mean 7 to activate the driving wheels 4 when loading the stretcher into the ambulance and, eventually, when unloading it.

In alternative, the invention provides that the device is provided with a single driving wheel 4 and/or that the connection of said wheel to the outlet shaft 8 of the driving member 5 is carried out by a chain, a trapezoidal belt, a gear box or angle transmission connected by a shaft or similar transmissions.

The driving member 5 is preferably connected to the front lower portion of the chassis 3 and comprises a motor 12, a reduction gear 13 and a clutch mean 14 cascade connected.

The motor 12 is electrical type fed by storage means, for example a rechargeable battery, of the feeding means 6 and is controlled by the control means 7 of electrical type.

More precisely, the motor 12 is direct current type and the control means 7 are switch type with forward and reverse motion as well as stop of the motor 12, or they are potentiometer type for adjusting the speed of the forward and reverse motion and the stop.

The clutch mean 14 could comprise an electromagnetic clutch controlled by the control means 7.

Optionally the clutch mean (14) could comprise a manual or electric operated transmission gear having at lest one transmission condition and a neutral condition.

The outlet shaft 8 of the clutch mean 14 is connected to the pulley 10 and, preferably, is disposed transversally in respect to the stretcher, parallel in respect to the shafts of motor and of the reduction gear.

In alternative the invention provides the adoption, in stead of the motor with the reduction gear, of a motor of the type having high torque even at very low revolutions speed and it provides that the clutch mean 14 can consist of, or can comprise, a manual or an automatic clutch or a speed change device.

The driving wheels 4 can comprise respective free wheel means 15, for example of so-called "ratchet and pawl" type, connecting to the transmission axis 17 to allow the operator to effect the loading of the stretcher into the ambulance, after the initial ramp tract, pushing it at a higher speed than the speed of the device.

The driving wheels 4 are provided with circumferential friction means 16, for example consisting of a rubber ring, fit to prevent the slipping on the ramp of the ambulance.

In alternative the invention provides the adoption of a small caterpillar tract, which is note and not shown, for example made of reinforced rubber or metal made with rubber inserts, each being engaged and tensioned between an idle wheel and a driving wheel 4.

The control means 7 are positioned in the rear portion of the stretcher for an easy operation by the operator.

The feeding means 6 and the connecting wirings C of these latter with the control means 7 and with the driving member 5 are fixed to the chassis 3.

Optionally the device could comprise at least first sensor means and second sensor means respectively fit for detecting a condition of stop in a vertical operating position of the front legs G of the stretcher 2 and a position of the stretcher 2 close to the external edge of the loading ramp in the exiting condition of the stretcher 2.

Said sensor means first and second are linked to the control means 7 to stop the driving member 5 and the at least one driving wheel 4 when the stretcher 2 is exiting out of the ambulance and at least one of the front legs G is not stopped in vertical operating position.

Such safety provision avoid the risk that the stretcher can come out from the ambulance without the correct positioning and blocking of the legs so rendering almost impossible the falling of the front portion of the stretcher.

The first sensor means comprises at least two switches or detectors, for instance of magnetic type, each connected to a safety lock of a respective front leg G.

The second sensor means comprises at least two switches or detectors, for instance of magnetic type, fixed to the ambulance, fit to match, one after an other, a matching mean, for instance e protrusion, of the stretcher 2 to detect the exiting condition of the stretcher 2 and the positioning of the front portion of the stretcher 2 close to the edge of the loading ramp.

The operation of the device provides, for example, that the operator pushes the stretcher with the patient until to the matching of the driving wheels 4 with the short ramp of the ambulance provided for the loading wheels of the normal stretchers and that, by means of the control means 7, he activates driving member 5 provoking to the controlled rotation of the drive wheels and the entrance of the stretcher into the ambulance.

It's important to observe that, advantageously, the device does not require any modification of the ambulances and it can be easily applied also to the stretchers existing before of the known type.

An advantage of the present invention is to provide a device for the assisted loading of a stretcher which can let the operator to reduce or to avoid the effort when loading and/or unloading the stretcher with the patient.

Other advantage is to provide a device which can reduce the impact between the legs of the stretcher and the ambulance in order to increase the comfort and the safety for the patient.

The invention claimed is:

1. A device for assisting loading onto a loading ramp of an ambulance a stretcher provided with a chassis and front pivoting legs pivotally attached to the chassis, said pivoting legs having idle wheels fit for moving the stretcher, said device comprises:

at least one driving wheel fixed in the front lower portion of the chassis, in front of the front pivoting legs remote from said idle wheels, in order to engage the loading ramp of the ambulance during loading and unloading of the stretcher; said at least one driving wheel is operably connected to a driving member which is electrically powered and controlled to activate the at least one driving wheel at least during the loading of the stretcher into the ambulance, and a transmission axis to which is fixed a pulley which is connected to the driving member and further connected to the transmission axis are two lateral wheels, at least one of which is the driving wheel, wherein the lateral wheels are each configured to free wheel at a higher speed than that provided by the driving member.

2. The device according to claim 1 wherein the at least one driving wheel is connected to a shaft of the driving member by one of a chain, a belt, a gear box, and an angle transmission.

3. The device according to claim 1 wherein the at least one driving wheel is connected to a shaft of the driving member by a, wherein said belt is engaged in respective pulleys of the shaft and of the at least one driving wheel.

4. The device according to claim 1 wherein the driving member comprises an electrical motor powered by a battery.

5. The device according to claim 1 wherein the driving member comprises a direct current electric motor and is controlled by switches for forward and reverse motor motions as well as to stop the motor.

6. The device according to claim 1 wherein the driving member comprises a direct current electric motor and is controlled by potentiometers for adjusting speed of forward and reverse motor motions.

7. The device according to claim 1 wherein the driving member comprises a reduction gear connected downstream to an electric motor.

8. The device according to claim 1 wherein the driving member comprises a clutch connected downstream to a reduction gear having a shaft connected to a pulley which drives the at least one driving wheel.

9. The device according to claim 1 wherein the driving member comprises a clutch connected downstream to a reduction gear having a shaft connected to a pulley which drives the at least one driving wheel, and wherein the clutch is one of a controlled electromagnetic clutch, a manual clutch, an automatic clutch, and a speed change device.

10. The device according to claim 1 wherein the driving member comprises a clutch connected downstream to a reduction gear having a shaft connected to a pulley which drives the at least one driving wheel, and wherein the clutch comprises a transmission gear having at least one transmission condition and a neutral condition.

11. The device according to claim 1 wherein the at least one driving wheel is configured to free wheel at a higher speed than that provided by the driving member.

12. The device according to claim 1 wherein the at least one driving wheel is provided with a device which provides circumferential friction to prevent slipping of the at least one driving wheel on the loading ramp of the ambulance.

13. The device according to claim 1 wherein the driving member is connected to the front lower portion of the chassis.

14. The device according to claim 1 wherein driving member is controlled by controls positioned at a rear portion of the stretcher.

* * * * *